US005729841A

United States Patent [19]

Chan

[11] Patent Number: 5,729,841

[45] Date of Patent: Mar. 24, 1998

[54] FOOT-MASSAGER

[75] Inventor: Wing Kin Chan, Kowloon, Hong Kong

[73] Assignee: China Pacific Trade Ltd., Virgin Islands (Br.)

[21] Appl. No.: 718,417

[22] PCT Filed: Mar. 30, 1995

[86] PCT No.: PCT/GB95/00757

§ 371 Date: Feb. 12, 1997

§ 102(e) Date: Feb. 12, 1997

[87] PCT Pub. No.: WO95/26706

PCT Pub. Date: Oct. 12, 1995

[30] Foreign Application Priority Data

Mar. 30, 1994 [GB] United Kingdom ..... 9406316

[51] Int. Cl.[6] ..... A47K 3/022

[52] U.S. Cl. ..... 4/622; 601/104; 601/99; 601/158; 601/166; 607/86; 607/87

[58] Field of Search ..... 4/621, 622; 601/51, 601/52, 55, 104, 22, 27, 28, 98, 99, 102, 103, 154, 158, 166; 607/85, 86, 87, 111

[56] References Cited

U.S. PATENT DOCUMENTS

| | | | |
|---|---|---|---|
| 2,781,040 | 2/1957 | Hill | 601/99 |
| 3,083,709 | 4/1963 | Lengsfeld | 601/104 |
| 3,965,495 | 6/1976 | McNair | 4/622 |
| 4,184,488 | 1/1980 | Bielich | 4/622 |
| 4,497,313 | 2/1985 | Kurosawa | 607/86 |
| 4,807,602 | 2/1989 | Scarborough et al. | 601/104 |
| 4,856,496 | 8/1989 | Chursinoff | 601/104 |
| 4,873,966 | 10/1989 | Gitter | 601/22 |
| 5,088,475 | 2/1992 | Steffensmeier | 601/102 |
| 5,417,644 | 5/1995 | Lee | 601/104 |

FOREIGN PATENT DOCUMENTS

| | | | |
|---|---|---|---|
| 2056959 | 5/1972 | Germany | 601/158 |
| 2156218 | 10/1985 | United Kingdom . | |
| 2157949 | 11/1985 | United Kingdom . | |

*Primary Examiner*—Charles R. Eloshway
*Attorney, Agent, or Firm*—Burns, Doane, Swecker & Mathis, L.L.P.

[57] ABSTRACT

A foot massager is provided in the form of a footbath (1) having first and second foot receiving portions (10). The base (2) of the footbath (1) is provided with a plurality of movable massaging elements (31, 50) to perform a massaging function on the feet. In one embodiment, the massaging elements are half-round projections (31) formed on a movable member (30) and which project through apertures (33) in an overlying fixed member (32), while in a second embodiment the massaging elements are rotating wheels (50) fixed on the movable member (30).

6 Claims, 3 Drawing Sheets

SECTION B-B

FOOT-MASSAGER

This invention relates to a footbath and in particular to a footbath having a massaging function.

Footbaths are known for soothing tired and aching feet. The footbath will comprise means for receiving water, optionally means for heating water, and optionally means for generating bubbles in the water to create a spa or JACUZZI-like effect. Also known are such footbaths provided with some form of massaging function. To date however the massaging functions provided by such prior footbaths have been very limited.

GB 2156218A describes a footbath which is in addition provided with various massaging means. In particular a vibrator is provided in order to have a massaging effect on the calf of a user, while massaging projections act on the soles of the feet. A vibrator is provided so that the massaging projections exert a massaging function. U.S. Pat. No. 4,569,337 discloses a massaging apparatus for the feet which is reversible between a dry condition in which it simply acts as a massager and a wet condition in which it acts as a footbath. A vibrator for effecting the massaging action is referred to, but is not described in any detail. U.S. Pat. No. 4,523,580 discloses a footbath where the foot supports within the footbath are reciprocated to achieve a massaging effect. U.S. Pat. No. 4,513,735 describes a footbath where foot supports are provided with protuberances, and in combination with a vibrating motor assembly and a vibrating plate these protuberances will carry out a massaging action.

U.S. Pat. No. 4,807,602 discloses a footbath having a housing containing a water storage tank, and an inclined floor on which are two feet receiving areas. On the floor is a reciprocating plate which supports a plurality of spaced upstanding foot supporting nipples of soft rubber material. The reciprocating plate is slidably received in a slot in the floor. The nipples extend through slots in a cover plate over the reciprocating plate. A motor reciprocates the reciprocating plate.

According to the present invention there is provided a footbath comprising, a bath unit for receiving a user's feet and having a base having first and second foot receiving areas on which in use rest the feet of a user, said base being provided at said feet receiving areas with a plurality of moveable massaging elements, the base being provided with overlying first and second members, the lowermost of said first and second members being provided with said massaging elements and the uppermost of said first and second members being provided with apertures corresponding to but larger than said massaging elements and through which said massaging elements protrude, and means or reciprocating the lowermost of said first and second members whereby said massage elements are caused to reciprocate within said apertures, characterised in that said massaging elements comprising massaging wheels mounted on said lowermost member for rotation, the axis of rotation of said wheels being substantially parallel to said lowermost member and normal to the direction of reciprocating movement.

Preferably the footbath includes heating means for heating the water therein. The footbath may include means for circulating the water and/or to aerate the water and/or to generate a whirlpool effect.

Preferably the drive means comprises a cam member that acts upon said lowermost member to cause reciprocal movement thereof. In one embodiment the cam member may comprise an eccentric member received within a recess formed in the underside of said lowermost first member.

In preferred embodiments of the invention the positions of the massaging elements within the feet receiving areas of the base of the footbath may be selected to correspond to predefined positions on the sole of a foot, and in particular to such positions that are considered to have an effect not only on the well-being of the foot but of the person generally.

The invention will now be described by way of example and with reference to the accompanying drawings, in which.

Figure 1:
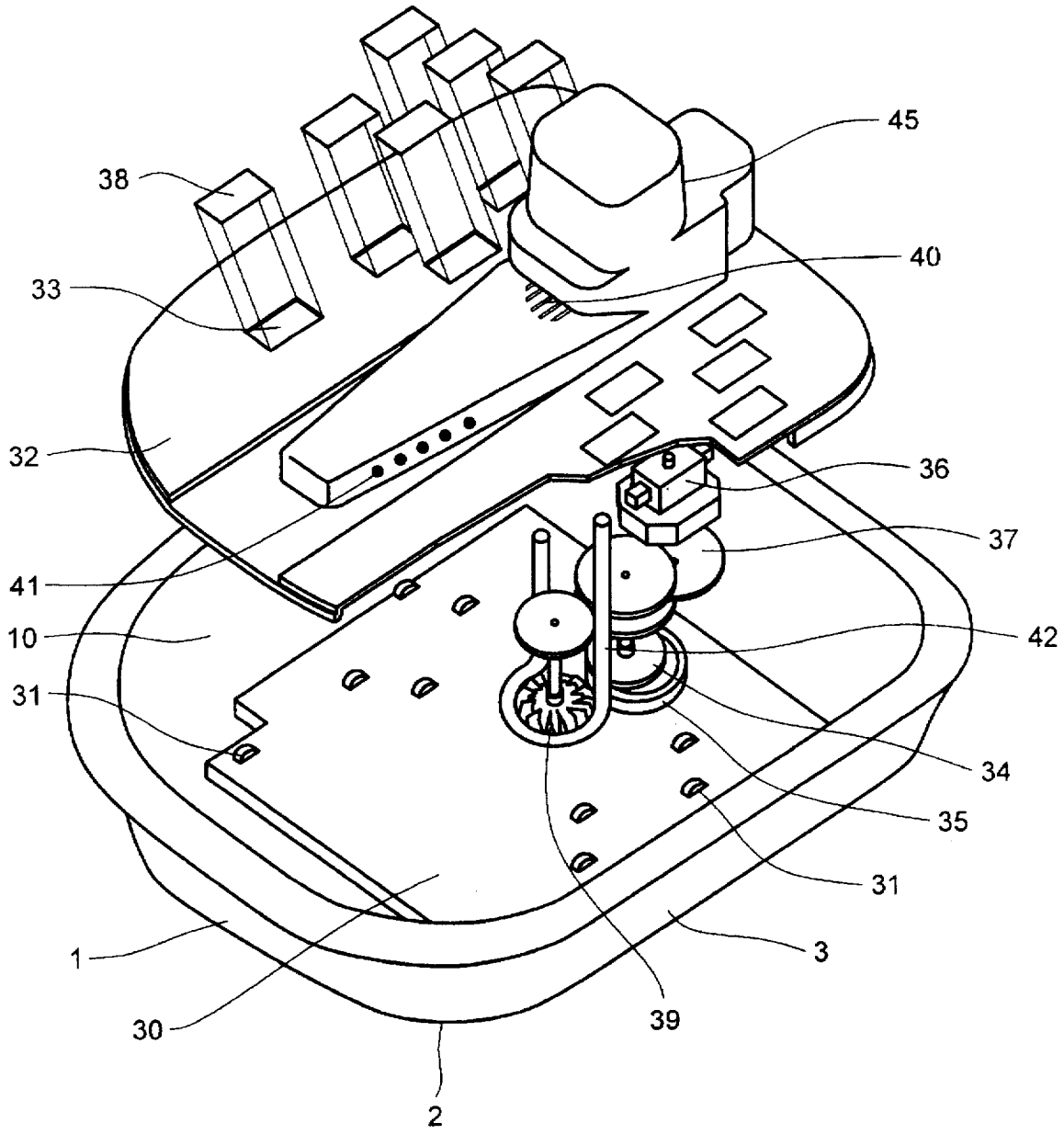
FIG. 1 is an exploded perspective view of a foot bath.

Referring firstly to FIG. 1 there is shown a footbath comprising a bath unit 1 for receiving a user's feet. The bath unit 1 comprises a base 2 and side walls 3, the side walls 3 being of sufficient height to permit the bath unit 1 to hold enough water to completely immerse feet located therein.

A first end of the bath unit 1 is left open and uncovered to define an aperture through which the feet of a user may be placed on foot receiving areas 10. A second end of the footbath may be covered by a removeable cover housing (not shown) within which are located control means for controlling temperature, bubbles, and the massaging function which will be described below.

The footbath is also provided with an electric heating element which is controlled through the control means for heating the water in the footbath. For safety reasons the heating element is either electrically insulated and/or is provided with an interlock means to prevent current passing through the heating element while the bath is in use.

Located within the footbath so as to rest on the base 2 are generally planar first and second members 30,32. The lowermost 30 of the two members is provided with a plurality of massaging projections 31 positioned at selected locations in areas of the lowermost member 30 corresponding to foot receiving areas of the footbath. The projections 31 in the footbath of FIG. 1 are generally semi-circular in shape and are formed integrally with the lowermost member 30.

The uppermost 32 of the two overlying members is provided with a plurality of apertures 33 corresponding in number and location to the projections 31 formed on the lowermost member 30. The apertures are slightly wider than the projections, and approximately twice the length in the direction of the heel-to-toe axis of a foot resting in the footbath. Thus the projections 31 project through the apertures 33 while allowing for relative movement of the projections 31 in the corresponding apertures. This relative movement is generated by the uppermost of the two overlying members being fixed while the lowermost member 30 is adapted to be driven along the axis A—A of FIG. 2, ie along the heel-to-toe axis of a foot in the footbath. The lowermost member 30 is driven axially by a rotating cam member 34 which acts upon member 30 by a cam follower 35 formed thereon. The cam member 34 in turn is driven by a motor 36 through gearing 37.

Each of the apertures 33 is provided with a covering of a soft plastics film 38 greater in area than the size of the aperture and being relatively flexible. By means of such film coverings the projections do not directly contact a foot and thus a smoother massaging effect can be obtained.

The cam member 34, motor 36, and gearing 37 are all located within a housing portion 45 formed as part of the uppermost member 32. Also located within this housing is a fan 39 which is also driven by the motor 36 and gearing 37. Fan 39 serves to create a whirlpool effect in the water within the bath by drawing water through inlets 40 and discharging it through outlets 41, both the inlets and outlets being formed in the housing portion 45 of the uppermost member 32.

Figure 2:
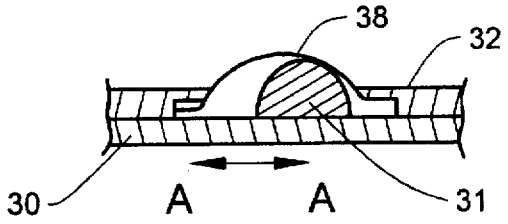
FIG. 2 is a side view of a detail of FIG. 1.

Also provided in the footbath of FIGS. 1 and 2 is an electric heating element 42.

The position of the massaging projections 31 are preferably appropriately chosen for maximum effect. For example the positions of the massaging elements can be chosen so as to correspond to those areas of the feet pressure on which is considered to effect other parts of the body or which are acupuncture points.

Figure 3:
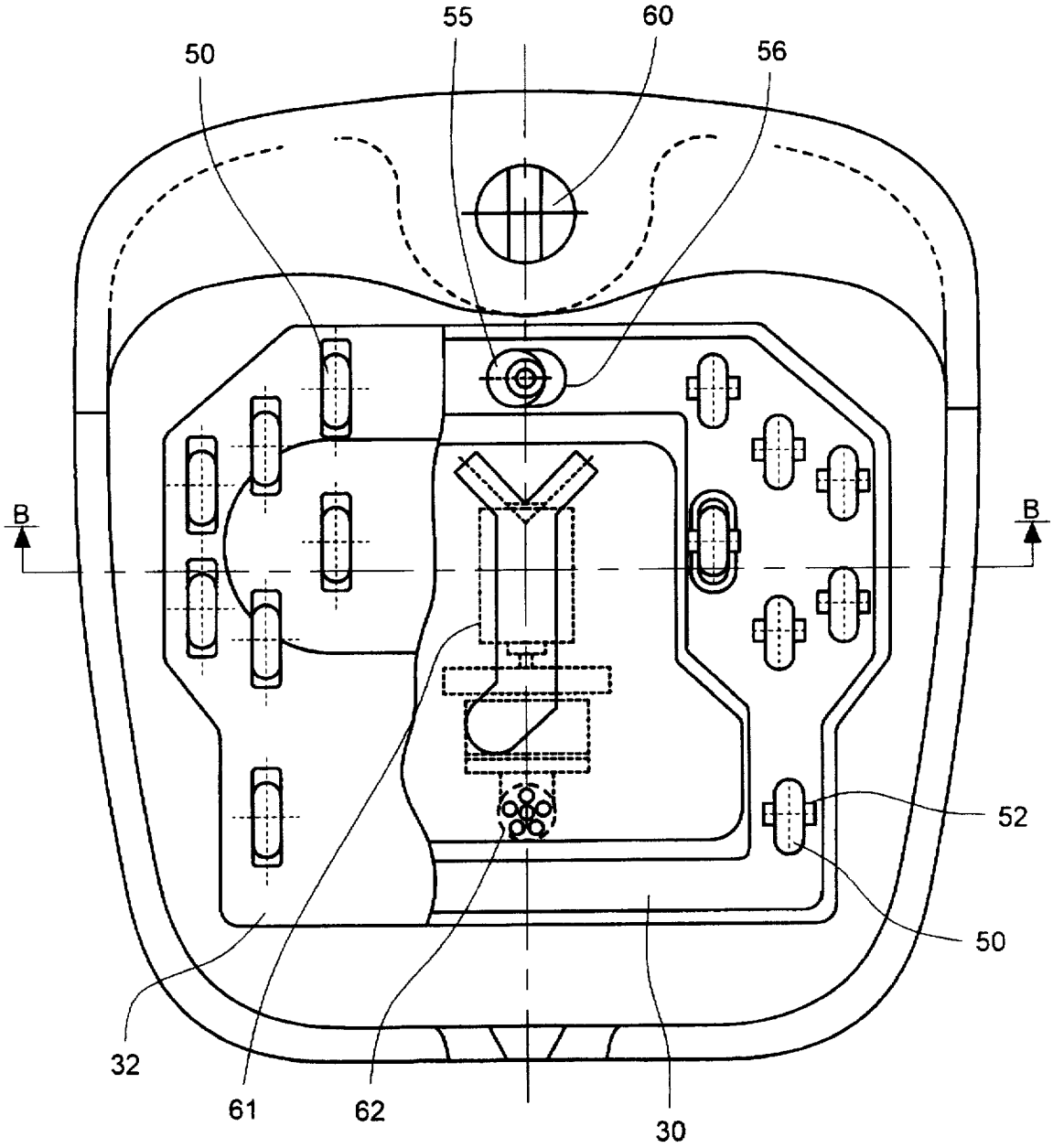
FIG. 3 is a plan view of an embodiment of a footbath in accordance with the invention.
Figure 4:
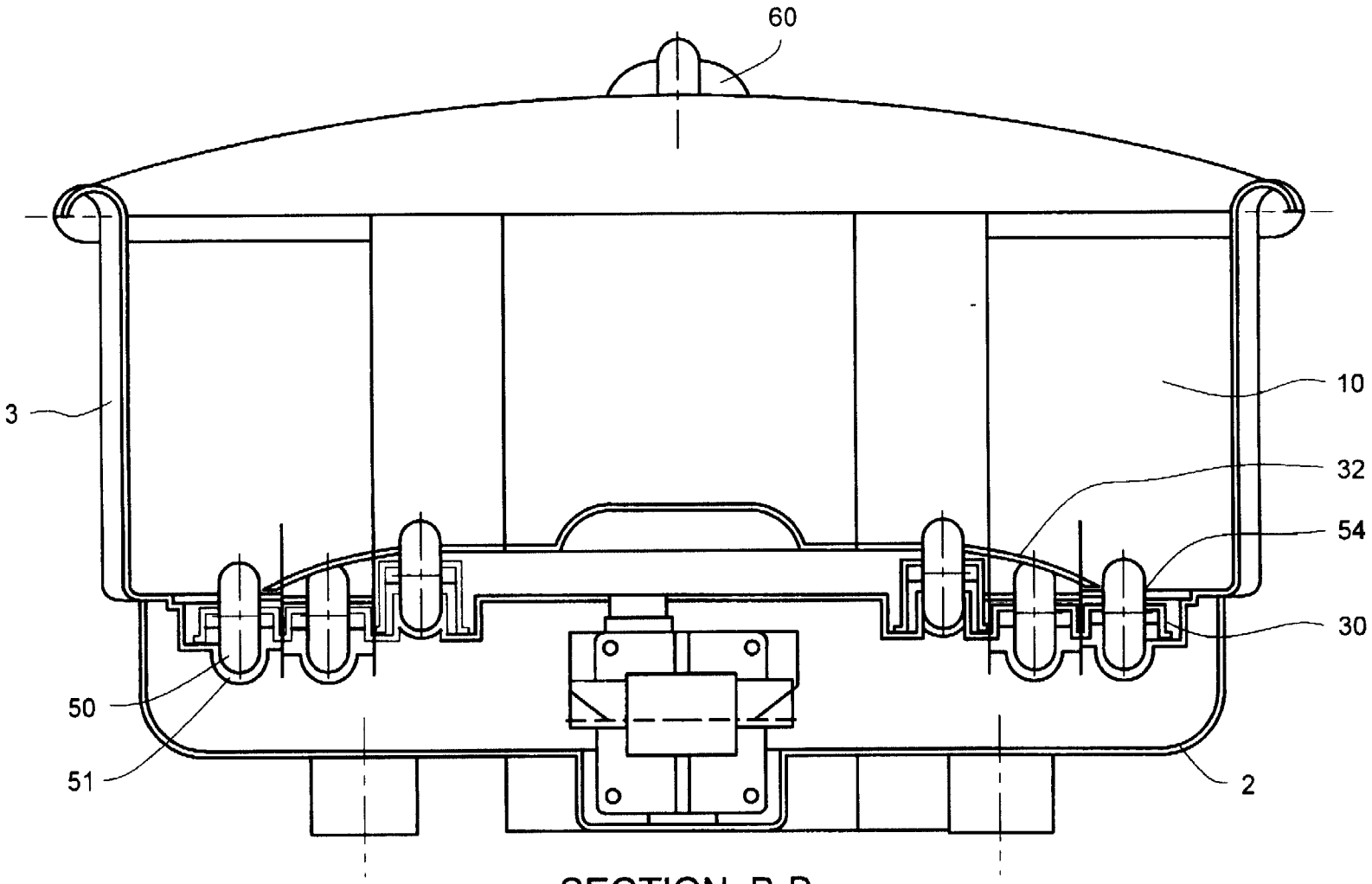
FIG. 4 is a sectional view along line B—B in FIG. 3.

FIGS. 3 and 4 show an embodiment of a footbath according to the present invention. In the footbath of FIGS. 1 and 2 the massaging elements are integrally formed with the lowermost of the first and second members 30, 32. In the embodiment of the invention shown in FIGS. 3 and 4 the massaging elements comprise rotating wheels 50 rotatably mounted on the first member 30 such that their axis of rotation lies in a plane parallel to the surface of the first member and at right angles to the direction of the reciprocating movement of the massaging elements. The first member 30 is provided with a plurality of shallow recesses 51 corresponding in number and location to the massaging elements 50 to facilitate the location thereof without the massaging elements projecting undesirably far from the surface of the first member, and bearing mountings 52 adjacent each said recess 51 for the rotatable mounting of the massaging wheels 50. By allowing the massaging elements to rotate a smoother massaging action may be obtained than with the integrally formed massaging projections of the footbath of FIGS. 1 and 2. The massaging wheels 50 protrude through the corresponding apertures 54 formed in the uppermost second member 32 so as to act upon the soles of feet resting thereon.

As in the footbath of FIGS. 1 and 2 the lowermost of the two members, first member 30 is caused to reciprocate relative to the upper second member 32 by means of a cam member. In the embodiment of the invention shown in FIGS. 3 and 4 the cam member comprises an eccentrically mounted circular member 55 which is located beneath the first member 30 and is received within an oval recess 56 formed in the underside of the first member. The eccentric member 55 is caused to rotate by being driven through a gear train from an electric motor as in the first embodiment, and rotation of the eccentric member causes the first member 30 to reciprocate in the heel-to-toe direction relative to the upper second member 32 and thus the massaging wheels 50 reciprocate within the apertures formed in the upper second member 32.

In the embodiment of the invention the motor and any associated gearing are located in the base of the footbath beneath the first member 30. The operation of the footbath may be controlled from a control switch 60 formed on the top of one end wall of the bath unit 1.

The embodiment of FIGS. 3 and 4 may also be provided with water heating means, water circulating means 61 and aerating means which are conventional in themselves and do not need further description.

What is claimed is:

1. A footbath comprising, a bath unit (1) for receiving a user's feel and having, a base (3) having first and second foot receiving areas (10) on which in use rest the feet of a user, said base (2) being provided at said feet receiving areas (10) with a plurality of moveable massaging elements (50), the base (2) being provided with overlying first (30) and second (32) members, the lowermost (30) of said first and second members being provided with said massaging elements (50) and the uppermost (32) of said first and second members being provided with apertures (54) corresponding to but larger than said massaging elements (50) and through which said massaging elements (50) protrude, and means (55) for reciprocating the lowermost (30) of said first and second members whereby said massaging elements (50) are caused to reciprocate within said apertures (54), characterised in that said massaging elements comprising massaging wheels (50) mounted on said lowermost member (30) for rotation, the axis of rotation of said wheels (50) being substantially parallel to said lowermost member (30) and normal to the direction of reciprocating movement.

2. A footbath as claimed in claim 1 comprising heating means (42) for heating water in the bath unit.

3. A footbath as claimed in claim 1 comprising means (61) for circulating water in the bath unit.

4. A footbath as claimed in claim 1 comprising means for aerating water in the bath unit.

5. A footbath as claimed in any preceding claim wherein said means for reciprocating comprises a cam member (55) that acts upon the lowermost member to cause the reciprocal movement when in use.

6. A footbath as claimed in claim 5 wherein said cam member comprises an eccentric member (55) received within a recess (56) in an underside of said lowermost member.

* * * * *